US005871075A

United States Patent [19]

Takayama et al.

[11] Patent Number: 5,871,075

[45] **Date of Patent: *Feb. 16, 1999**

[54] COIN SORTING MACHINE

[75] Inventors: Shigeki Takayama; Hiroshi Ohtomo, both of Saitama, Japan

[73] Assignee: Asahi Seiko Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 591,975

[22] Filed: Jan. 29, 1996

[30] Foreign Application Priority Data

Jan. 27, 1995 [JP] Japan ..... 7-046088

[51] Int. Cl.[6] ..... G07D 5/08

[52] U.S. Cl. ..... 194/318

[58] Field of Search ..... 194/317, 318

[56] References Cited

U.S. PATENT DOCUMENTS

| | | | |
|---|---|---|---|
| 3,870,137 | 3/1975 | Fougere | 194/317 |
| 4,963,118 | 10/1990 | Gunn et al. | 194/317 X |
| 4,995,497 | 2/1991 | Kai et al. | 194/318 |
| 5,263,566 | 11/1993 | Nara et al. | 194/318 |
| 5,323,891 | 6/1994 | Waite | 194/318 |

FOREIGN PATENT DOCUMENTS

| | | |
|---|---|---|
| 0202378 | 11/1986 | European Pat. Off. . |
| 0392110 | 10/1990 | European Pat. Off. . |
| 9103032 | 3/1991 | WIPO . |
| 9304448 | 3/1993 | WIPO . |

*Primary Examiner*—F. J. Bartuska
*Attorney, Agent, or Firm*—Sughrue, Mion, Zinn, Macpeak & Seas, PLLC

[57] ABSTRACT

A low-cost, high-performance coin sorting machine is provided by providing a plurality of coils which sense coins concurrently and using a simple oscillation circuit to provide oscillation signals at different frequencies, thereby reducing the size of the coin sorting machine. Right and left pairs of sensor coils are composed of inner and outer coils. When either of the connections between one inner coil and other inner coil, and between one outer coil and the other outer coil, is made in a cumulative mode, the other connection is made in a differential mode. The relationship between the oscillation frequencies is set so that one of the frequencies is greater than twice the other.

14 Claims, 6 Drawing Sheets

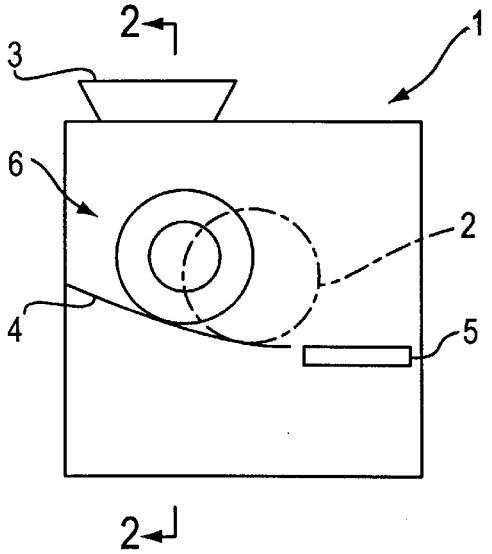
FIG. 1
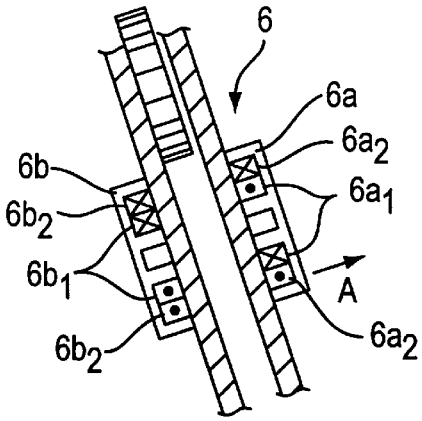
FIG. 2
FIG. 3
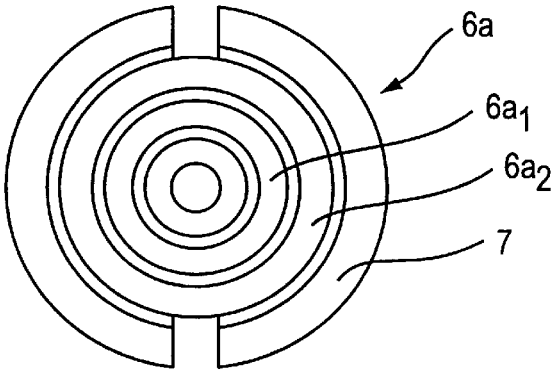

COIN SORTING MACHINE

FIELD OF THE INVENTION

The present invention relates to coin sorting machines of a type which can be incorporated into various coin-operated machines, such as vending machines, money-changing machines and game machines. More specifically, the invention relates to a coin sorting machine that electronically detects the size and material of coins and sorts the coins accordingly.

BACKGROUND OF THE INVENTION

Coin sorting machines are conventionally known which determine whether to accept an inserted coin depending on changes in impedance of a circuit which occur when the inserted coin blocks the magnetic flux developed by a coin sorting coil. Such a coin sorting machine is described in U.S. Pat. No. 3,870,137.

In the machine described in U.S. Pat. No. 3,870,137 coins formed with thin outer layers laminated on an inner, center layer of a different material (laminated coins), such as dimes (10 cents) and quarters (25 cents), are sorted by detecting the two types of materials of the coin, i.e., the materials of both the inner layer and the outer layers.

For this purpose, advantage is taken of the fact that although a magnetic flux of a relatively low frequency penetrates far into the coin, a magnetic flux of a relatively high frequency penetrates only the thin outer layer of the coin. Accordingly, a plural number of oscillators are provided which produce oscillation signals of relatively low and high frequencies, thereby allowing for the detection of the inner and outer materials of the coin. Specifically, oscillation coils of the oscillator circuits are arranged along a coin passage so as to cause the coin first to pass through a low-frequency magnetic flux and subsequently through a high-frequency magnetic flux as it is being conveyed.

In a second type of conventional coin sorting machine, as disclosed in Japanese Patent Laid-Open No. 3-180992, transmitting and receiving coils as well as an oscillator are provided. The transmitting coil is disposed opposite to the receiving coil with the coin passage lying therebetween, and the oscillator is arranged to alternatively apply currents of different frequencies to the transmitting coil. Like the first-described conventional coin sorting machine, on which it is an improvement, the second type of conventional coin sorting machine also takes advantage of the fact that as the frequency of the applied current increases, the penetration depth of the induced flux into the coin is reduced.

However, the aforedescribed conventional examples have the following problems.

In the first type of coin sorting machine, because a plurality of oscillation coils are arranged along the coin passage, during the time period from the instant an inserted coin passes the first oscillation coil until it passes the last oscillation coil, it is not possible to determine whether to accept another coin. It is also necessary to extend the coin passage in the direction of coin movement to accommodate the oscillation coils. Thus, the time required to make a decision after a coin is inserted is relatively long. As a result, it may occur that the time between the decision to accept a coin and the activation of an acceptance mechanism, such as an acceptance gate, is insufficient. To secure sufficient time, for such purpose, it thus may be necessary to extend the distance from the oscillation coil to the acceptance mechanism. Consequently, the overall coin sorting machine may become bulky.

In the second type of coin sorting machine, because a single pair of transmitting and receiving coils is utilized, it is not necessary to increase the length of the coin passage or to otherwise increase the overall size of the device. However, the oscillator which applies in succession currents of different frequencies to the transmitting coil is complex in structure and expensive.

Accordingly, it is an object of the present invention to provide an inexpensive, high-performance coin sorting machine whose size, and hence decision time, is reduced by minimizing the coin passage length, which is capable of handling more than one coin simultaneously, and in which a simple oscillation circuit is used to provide oscillation signals of different frequencies.

SUMMARY OF THE INVENTION

According to the invention, a coin sorting machine is provided which comprises a coin slot, a coin passage along which a coin inserted through the coin slot is allowed to roll, sensor coils facing the sides of the coin rolling along the coin passage, and decision means for detecting the influence of the coin on the magnetic flux of the sensor coils and sorting the loaded coins accordingly, wherein the sensor coils include one coil disposed on one side of the coin passage and the another coil disposed opposite the coil, with the coin passage lying therebetween, and wherein the one coil includes a first inner coil and a first outer coil surrounding the first inner coil, and the other coil includes a second inner coil and a second outer coil surrounding the second inner coil.

With the first inner coil and second inner coil connected together, and the first outer coil and the second outer coil connected together, if the first inner coil and the second inner coil are connected in the cumulative mode, then the first outer coil and the second outer coil are connected in the differential mode, while if the first inner coil and the second inner coil are connected in the differential mode, then the first outer coil and the second outer coil are connected in the cumulative mode.

Assuming that the frequency of an oscillation circuit including the first inner coil and the second inner coil is a first frequency, and the frequency of an oscillation circuit including the first outer coil and the second outer coil is a second frequency, the relationship between the first and second frequencies is set so that one of them is greater than twice the other.

The first inner coil and first outer coil, and/or the second inner coil and second outer coil, may be wound around a single core.

Further, the first inner coil and first outer coil, and/or the second inner coil and second outer coil, may be concentric.

Also, the first inner coil and first outer coil, and/or the second inner coil and second outer coil, may be similar in configuration (shape).

Further according to the invention, a coin sorting machine comprises a coin slot, a coin passage along which a coin inserted through the coin slot is allowed to roll, sensor coils facing the sides of the coin rolling along the coin passage, and decision means for detecting the influence of the coin on the magnetic flux of the sensor coils and to sort the coins accordingly, wherein the sensor coils include one coil disposed on one side of the coin passage and the other coil disposed opposite the coil, with the coin passage lying therebetween, and wherein the one coil includes a first coil and a first overlapping coil that overlaps in the thickness direction of the first coil and is concentric therewith, and the other coil includes a second coil and a second overlapping coil that overlaps in the thickness direction of the second coil and is concentric therewith.

With the first coil and second coil connected together and the first overlapping coil and second overlapping coil connected together, if the first coil and second coil are connected in the cumulative mode, then the first overlapping coil and second overlapping coil are connected in the differential mode, while if the first coil and the second coil are connected in the differential mode, then the first overlapping coil and second overlapping coil are connected in the cumulative mode.

Assuming that the frequency of an oscillation circuit including the first coil and second coil is a first frequency and the frequency of an oscillation circuit including the first overlapping coil and second overlapping coil is a second frequency, then the relationship between the first and second frequencies is set so that one of them is greater than twice the other.

With the coin sorting machine according to this embodiment, at least one of the combinations of the first coil and first overlapping coil and of the second coil and second overlapping coil is formed with the same diameter of coils.

At least one of the combinations of the first coil and first overlapping coil and of the second coil and second overlapping coil is formed with similar configurations of the coils.

The first frequency ranges from 10 to 200 kHz.

As a coin inserted through the coin slot moves along the coin passage, it blocks the magnetic flux generated by the sensor coils, thereby causing changes in impedance of the sensor coils. Then, one coil of the sensor coils is driven with a signal at a lower frequency so that the resulting magnetic flux mainly penetrates into the moving coin, while the signal driving the other coil is set at a higher frequency so that its magnetic flux mainly penetrates the skin of the passing coin. Thus, both cause respective specific changes in impedance due to the materials of the passing coin. These changes are compared against data on coins to be accepted which is stored in the decision means, and, if the result is within a predetermined range, then it is determined that the passing coin is to be accepted, and if not, it is rejected.

BRIEF DESCRIPTION OF THE DRAWINGS

FIG. 1 is a cross-sectional view of a coin sorting machine constructed according to the present invention.

FIG. 2 is a cross-sectional view taken along line I—I in FIG. 1.

FIG. 3 is a plan view of one coil.

DESCRIPTION OF THE PREFERRED EMBODIMENTS

In order to solve the aforedescribed problems of the prior art, the inventors conducted various tests by arranging a plurality of coils. More specifically, instead of arranging a plurality of coils along the coin passage, the coils are classified into two categories: inner coils with a smaller diameter and outer coils with a larger diameter disposed surrounding the inner coils. The connection mode for the inner coils with each and the outer coils with each other is selected, and currents of different frequencies, i.e., low frequency (LF) and high frequency (HF), are applied to each coil. The results were observed in detail.

By trying various connection modes, the inventors found that when the inner coils and outer coils are connected in the same mode, i.e., when the inner coils are connected in a cumulative connection mode (differential connection mode) and the outer coils are also connected in the cumulative connection mode (differential connection mode), the resulting waveform was disturbed regardless of the frequencies applied to both coils, so that changes in impedance caused by the passage of a coin could not be detected accurately.

It should be noted that the term "cumulative connection" used herein means that the magnetic flux generated by one coil is added to the flux generated by another coil with which the first coil is cumulatively connected, while the term "differential connection" means that the magnetic flux generated by one coil is canceled by the flux generated by the other coil.

Figure 4A:
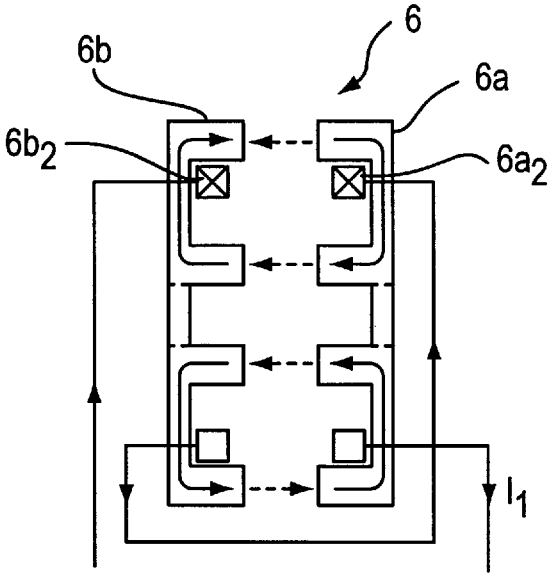
FIG. 4(A) and 4(B) are simplified views illustrating the connection mode of the coils in Embodiment 1.
Figure 4B:
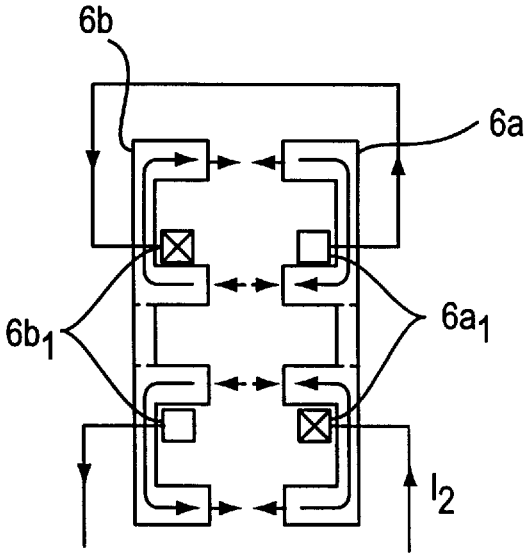

On the other hand, if the inner coils **6*a*1, 6*b*1 are connected to each other in the differential connection mode as shown in FIG. 4(A) and the outer coils 6*a*2, 6*b*2 are connected in the cumulative connection mode as shown in FIG. 4(B), then variations in impedance can be read acceptably. Moreover, if the inner coils are connected in the cumulative mode and the outer coils are connected in the differential mode, changes in impedance can also be read acceptably (not shown). It should be noted that the arrows shown in FIGS. 4(A) and 4**(B) denote magnetic lines of flux.

Figure 9:
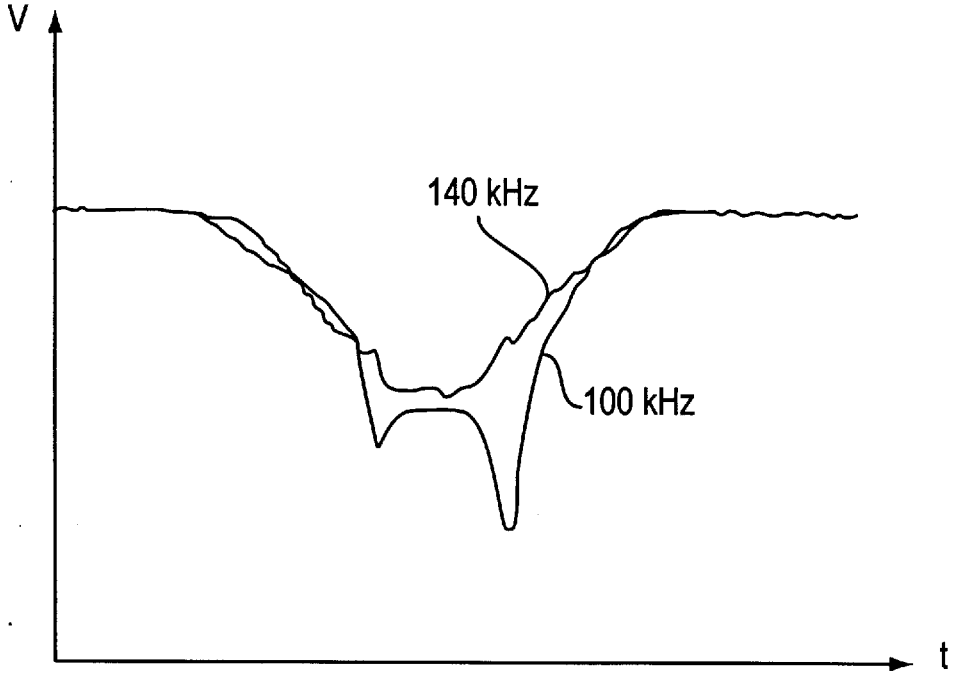
FIG. 9 is a diagram depicting how LF and HF magnetic fluxes interfere with each other.

Next, with the relationship between LF and HF in mind, the inventors conducted tests to determine how close the two frequencies can be by testing various values of both frequencies. The results indicate that when HF is less than 2LF (2LF>HF), the signals of the two frequencies interfere with each other so that changes in impedance could not be read acceptably. FIG. 9 is a graph showing results with a LF of 100 kHz and an HF of 140 kHz.

On the other hand, if HF is greater than 2LF (2LF<HF), there was no problem in detecting changes in impedance. More preferably, it was found that if 6 kHz is used for LF and 120 kHz or higher is used for HF, then no interference would occur between the two frequencies, so that coins could be sorted acceptably.

Consequently, the inventors employed the following configurations to solve the above problem of the prior art.

Embodiment 1

The coin sorting machine of this embodiment, which may be employed, for example, in various types of vending and game machines, is shown in simplified front cross-sectional view in FIG. 1. In FIG. 1, the size of sensor coils and other components is exaggerated for ease of understanding.

A coin sorting machine 1 includes a coin slot 3 into which a coin 2, denoted by a broken line, is inserted, a coin passage 4 along which the inserted coin is allowed to roll, a coin passage gate 5 provided in the downstream section of the coin passage 4, and sensor coils 6 facing the sides of the coin rolling along the coin passage 4.

FIG. 2 shows a cross-sectional view taken along line I—I in FIG. 1. The sensor coils 6 is composed of a pair of coils **6*a* and 6*b* arranged opposite to each other with the coin passage 4 lying therebetween. FIG. 3 shows the state of one coil 6***a* as viewed from the coin passage 4 (direction of arrow A in FIG. 2). It should be appreciated that the coils 6*a* and 6*b* need not necessarily be of the same shape; however, in the present embodiment, because the other coil 6*b* is structured in the same shape as the coil 6*a*, only the first coil 6*a* will be described herein.

The one coil 6*a* is composed of a first inner coil $6a_1$ and a first outer coil $6a_2$ surrounding the first inner coil $6a_1$, both being circular in shape and wound concentrically. The two coils are placed in a circular ferrite core 7. It should be appreciated that the sensor coils 6 and ferrite core 7 need not be circular in shape, and any other shape may be used.

The center of the first inner coil $6a_1$ and first outer coil $6a_2$ may be arranged so that the trajectory followed by the center of the loaded coin rolling along the coin passage 4 follows that center. The distance from the sensor coil to the coin passage gate 5 should be optimized relative to the operating time of a solenoid (not shown) that actuates the coin passage gate 5, although it may be reduced according to a reduction in the coin determination time, as compared to case where multiple sets of sensor coils are arranged along the coin passage.

Next, the connection modes of the coils are described.

The inner coils 6*a*1, 6*b*1 or the outer coils 6*a*2, 6*b*2 are not connected to each other in the same connection mode, that is, the two are not both connected in the cumulative mode or the differential mode. This is intended to prevent both the inner and outer coils from interfering with each other. Thus, if one is connected in the cumulative mode, the other should be connected in the differential mode.

This will be explained in greater detail with reference to FIGS. 4(A) and 4(B). FIGS. 4(A) and 4(B) illustrate the currents $I_2$ and $I_1$ flowing through the outer coils 6*a*2, 6*b*2 and the inner coils 6*a*2, 6*b*2, respectively, at a given instant and the resulting magnetic flux. In FIG. 4(A), both outer coils 6*a*2, 6*b*2 are wound in the same direction, i.e., connected in the differential mode, so that the magnetic flux generated by the first 6*a*2 and second 6*b*2 outer coils is added to each other.

In FIG. 4(B), on the other hand, both inner coils 6*a*1, 6*b*1 are wound in different directions, i.e., connected in such a manner that the magnetic flux produced by the first inner coil 6*a*1 is canceled by the magnetic flux produced by the second inner coil 6*b*1. It should be appreciated by those skilled in the art that by reversing the connection modes of the present embodiment, that is, by connecting the outer coils 6*a*2, 6*b*2 and the inner coils 6*a*2, 6*b*2 in the differential and cumulative modes, respectively, similar effects will be achieved.

Next, the relationship between LF and HF is described with reference to FIGS. 6 and 7.

Figure 6:
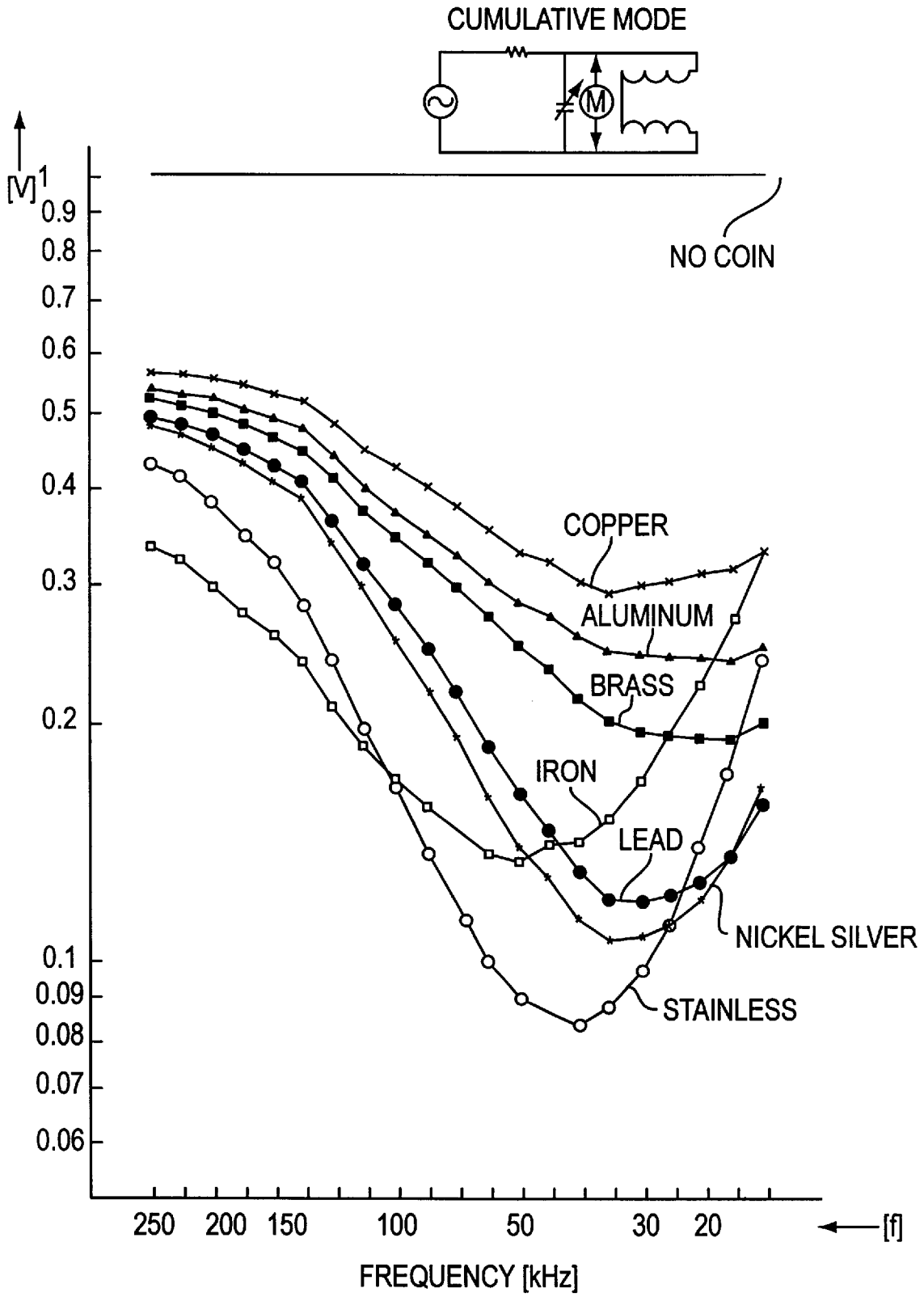
FIG. 6 is a diagram showing characteristic data for the coils connected in a cumulative mode.
Figure 7:
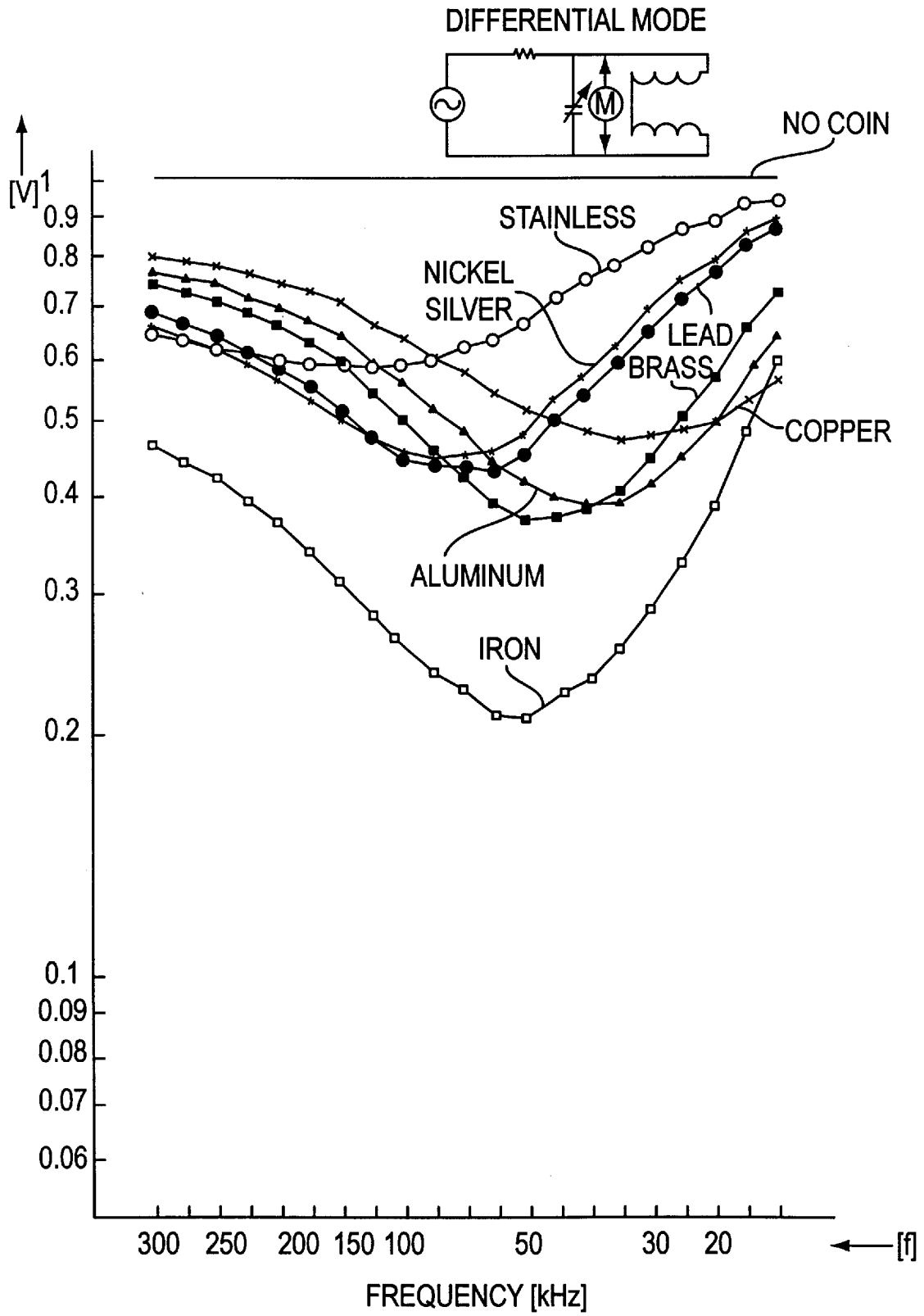
FIG. 7 is a diagram showing characteristic data for the coils connected in a differential mode.

FIG. 6 shows the state where the first and second outer coils 6*a*2, 6*b*2 are connected to each other in the cumulative mode, and FIG. 7 shows the state where the first and second inner coils 6*a*1, 6*b*1 are connected to each other in the differential mode. In the graphs of these figures, the horizontal axis denotes oscillation frequency and the vertical axis represents voltage. The voltage of the oscillation circuit 11*a* or 11*b* with no coin present is set to 1 V. The two figures show how the voltage drops when a coin made of materials indicated in those figures is inserted.

As for the materials of the coin, copper, aluminum, brass, iron, lead, nickel silver (an alloy of nickel, copper and zinc, plated with silver), and stainless steel can be used with the present embodiment.

Referring to the graph of FIG. 6, when the oscillation frequency is set near 30 kHz, the voltage changes substantially in the order of copper, aluminum, brass, iron, lead, nickel silver, and stainless steel. Referring to the graph of FIG. 7, on the other hand, when the oscillation frequency is set near 60 kHz, the voltage changes substantially in the order of stainless steel, nickel silver, lead, aluminum, brass and iron. In this case, the former is connected in the cumulative mode, while the latter is connected in the differential mode. By reversing these modes, that is, by connecting the former in the differential mode and the latter in the cumulative mode, similar values can be observed. For example, stainless steel, the material with the most substantial change observed when connected in the cumulative mode, it will exhibit the least substantial change when the differential mode is employed. In this way, prominent changes in voltage can be read by selecting the oscillation frequency and connection mode as appropriate.

In the present embodiment, a frequency near 30 kHz is used as LF (in the cumulative connection mode), while a frequency near 180 kHz is used as HF (in the differential connection mode). Such frequencies are used because if HF is set greater than or equal to twice of LF, then changes in voltage are well exhibited without mutual interference of these frequencies. Tests conducted by the inventors found that it is desirable to use a frequency ranging from 10 kHz to 200 kHz as LF, and to use a frequency greater than or equal to 20 kHz as HF.

Figure 5:
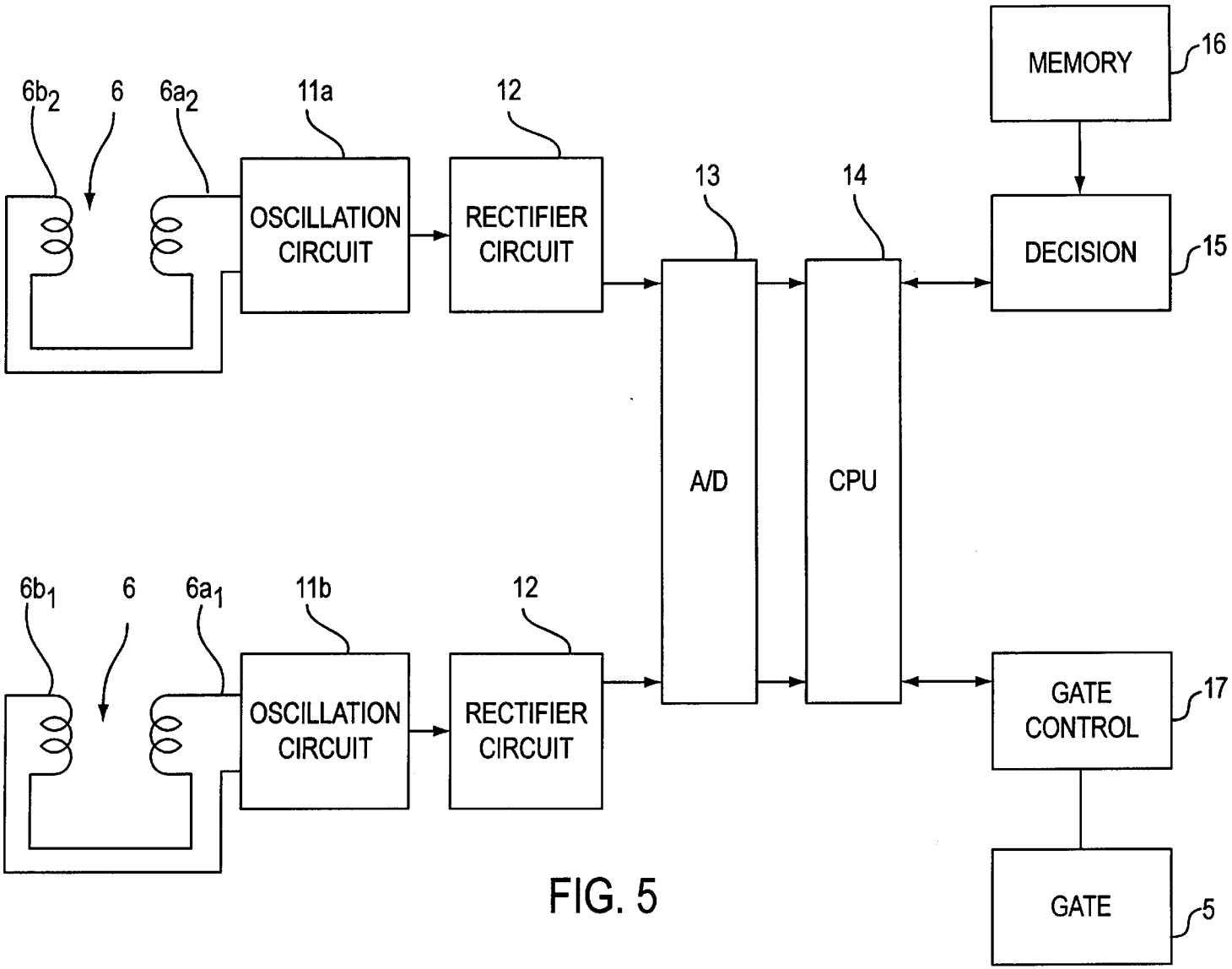
FIG. 5 is a diagram depicting an electrical circuit of the coin sorting machine according to the present invention.

Next, the process flow for determination and sorting of the inserted coin is described with reference to FIG. 5.

Coin characteristic data detected by a first oscillation circuit 11*a* including the first sensor coil 6*a* and a second oscillation circuit 11*b* including the second sensor coil 6*b* is inputted to a CPU 14 via a rectifier circuit 12 and an A/D converter 13. The inputted coin characteristic data is stored in the CPU 14 and also sent to decision unit 15. The decision unit 15 compares the coin characteristic data against normal coin data provided by storage unit (memory) 16 that stores the data on coins to be accepted, determines whether the result falls within a predetermined range, and sends the decision result to the CPU 14.

If the decision result falls within a predetermined range, that is, if the inserted coin is a coin to be accepted, then the CPU 14 issues an OPEN GATE command to gate control unit 17, thereby opening a gate 5, so that the coin is guided toward a coin acceptance chute (not shown).

On the other hand, if the inserted coin is not a coin to be accepted, the gate 5 is not opened because the OPEN GATE command is not issued, in which case the coin is guided toward a coin rejection chute (not shown).

Embodiment 2

In Embodiment 2, the shape of the sensor coils is different, although the fundamental operation is similar to that of Embodiment 1.

Figure 8:
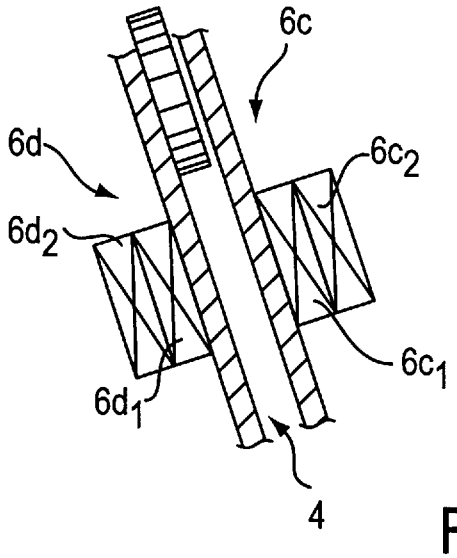
FIG. 8 is a simplified view illustrating the connection mode of the coils in Embodiment 2.

More specifically, Embodiment 2 is similar to Embodiment 1 in that one coil 6*c* and the other coil 6*d* are arranged opposite to one another with the coin passage lying therebetween, as shown in FIG. 8. The one coil 6*c* is composed of a first coil $6c_1$ and a first overlapping coil $6c_1$. The first overlapping coil $6c_1$ is disposed in such a position that it is separated from the coin passage in the thickness direction of the first coil $6c_1$. The other coil 6*d* is composed of a second coil $6d_1$ and a second overlapping coil $6d_1$. The second overlapping coil $6d_1$ is disposed in such a position that it is separated from the coin passage 4 in the thickness direction of the second coil $6d_1$. The connection mode and oscillation frequency for each coil are similar to those of Embodiment 1.

In Embodiment 2, the first coil $6c_1$ and first overlapping coil $6c_1$ of which the one coil 6*c* is composed, and the second coil $6d_1$ and second overlapping coil $6d_1$ of which the other coil 6*d* is composed, are shaped concentrically and with the same diameter, but the invention is not limited to such an arrangement. The coil of either of the combinations may have a similar configuration.

When the coin sorting machine according to the present invention is employed, the decision time may be minimized because plural oscillation coils are not arranged along the coin passage. In other words, the coin sorting machine can be reduced in size by allowing a plurality of coils to determine coins concurrently. Furthermore, a simple oscillation circuit may be used to provide oscillation at different frequencies, thereby achieving a high-performance coin sorting machine at low cost which is capable of reliably identifying coins, such as laminated coins.

What is claimed is:

1. A coin sorting machine, comprising:

a coin slot;

a coin passage along which a coin inserted through said coin slot rolls;

first and second sensor coils facing respective sides of a coin rolling along said coin passage;

first and second oscillator circuits including said first and second sensor coils, respectively, and oscillating at first and second frequencies, respectively; and decision means for detecting the influence of a coin rolling along said coin passage on the magnetic flux of said sensor coils to sort coins accordingly, wherein:

each said sensor coils comprises a first coil disposed on one side of said coin passage and a second coil disposed opposite said first coil, said coin passage lying between said first and second coils;

said first coil comprises a first inner coil and a first outer coil surrounding said first inner coil without any ferrite separator therebetween;

said second coil comprises a second inner coil and a second outer coil surrounding said second inner coil without any ferrite separator therebetween;

said first inner coil and said second inner coil are connected in one of a cumulative mode and a differential mode, and said first outer coil and said second outer coil are connected in the other of said cumulative mode and said differential mode; and one of said first and second frequencies is greater than twice the other.

2. A coin sorting machine according to claim 1, wherein at least one of the combination of said first inner coil and said first outer coil and the combination of said second inner coil and said second outer coil are wound around a single core.

3. A coin sorting machine according to claim 1, wherein at least one of the combination of said first inner coil and said first outer coil and the combination of said second inner coil and said second outer coil are concentric.

4. A coin sorting machine according to claim 1, wherein at least one of the combination of said first inner coil and said first outer coil and the combination of said second inner coil and said second outer coil have similar shapes.

5. A coin sorting machine according to claim 1, wherein said first frequency is in a range of 10 to 200 kHz.

6. A coin sorting machine according to claim 2, wherein said first frequency is in a range of 10 to 200 kHz.

7. A coin sorting machine according to claim 3, wherein said first frequency is in a range of 10 to 200 kHz.

8. A coin sorting machine according to claim 4, wherein said first frequency is in a range of 10 to 200 kHz.

9. A coin sorting machine, comprising:

a coin slot;

a coin passage along which a coin inserted through said coin slot rolls;

first and second sensor coils disposed on respective opposite sides of said coin passage;

first and second oscillator circuits including said first and second sensor coils, respectively, and oscillating at first and second frequencies, respectively; and decision means for detecting the influence of a coin rolling along said coil passage on the magnetic flux of said sensor coils to sort inserted coins accordingly, wherein:

said sensor coils comprises a first coil and a first overlapping coil that overlap in a thickness direction of said first coil without any ferrite separator therebetween, said first overlapping coil being concentric with said first coil;

said second sensor coil comprising a second coil and a second overlapping coil that overlap in a thickness direction of said second coil without any ferrite separator therebetween, said second overlapping coil being concentric with said second coil;

said first sensor coil and said second sensor coil are connected together in one of a cumulative mode and a differential mode, and said first overlapping coil and said second overlapping coil are connected together in the other of said cumulative mode and said differential mode; and one of said first and second frequencies is greater than twice the other, and wherein said decision means stores for comparison the voltage and frequency characteristics of a plurality of coin materials for each of said first and second frequencies and the corresponding one of said cumulative mode and differential mode.

10. A coin sorting machine according to claim 9, wherein at least one of the combination of said first coil and said first overlapping coil and the combination of said second coil and said second overlapping coil is formed with the same diameter of coils.

11. A coin sorting machine according to claim 9, wherein at least one of the combination of said first coil and said first overlapping coil and the combination of said second coil and said second overlapping coil is formed with coils of similar shapes.

12. A coin sorting machine according to claim 9, wherein said first frequency is in a range of 10 to 200 kHz.

13. A coin sorting machine according to claim 10, wherein said first frequency is in a range of 10 to 200 kHz.

14. A coin sorting machine according to claim 11, wherein said first frequency is in a range of10 to 200 kHz.

* * * * *